United States Patent [19]

Cordray

[11] Patent Number: 4,605,361

[45] Date of Patent: Aug. 12, 1986

[54] OSCILLATING VANE ROTARY PUMP OR MOTOR

[76] Inventor: Robert K. Cordray, 1441 W. 46th Ave., #17, Denver, Colo. 80211

[21] Appl. No.: 693,136

[22] Filed: Jan. 22, 1985

[51] Int. Cl.[4] ..... F02B 53/00

[52] U.S. Cl. ..... 418/38

[58] Field of Search ..... 123/18 R, 18 A, 245; 418/35, 38

[56] References Cited

U.S. PATENT DOCUMENTS

| | | | |
|---|---|---|---|
| 1,271,950 | 7/1918 | Saunders | 418/38 X |
| 2,673,027 | 3/1954 | Lipkau . | |
| 2,734,489 | 2/1956 | Tschudi . | |
| 3,183,898 | 5/1965 | Sandone . | |
| 3,505,981 | 4/1970 | Turnbull | 418/38 |
| 4,153,396 | 5/1979 | Landry | 418/38 |
| 4,194,871 | 3/1980 | Studenroth | 418/38 |

FOREIGN PATENT DOCUMENTS

| | | | |
|---|---|---|---|
| 547593 | 3/1932 | Fed. Rep. of Germany | 123/245 |
| 3015931 | 12/1981 | Fed. Rep. of Germany | 418/38 |

*Primary Examiner*—Michael Koczo

*Attorney, Agent, or Firm*—Ralph F. Crandell

[57] ABSTRACT

An oscillating vane rotary pump or motor. The pump or motor comprises a cylinder with a pair of co-axial rotors journaled in the cylinder. Each of the rotors defines a pair of spaced apart sector shaped vanes with the vanes of one rotor intermediately juxtaposed with the vanes of the other. A power shaft journaled in the cylinder includes a quill or sleeve shaft which drivingly engages the co-axial rotor shafts. Inlet ports and outlet or exhaust ports are provided in the cylinder for receiving and exhausting pressure fluid. Operative coupling means are provided for oscillating the rotors and vanes with respect to each other as the rotors rotate with respect to the cylinder. A drive pin extends through the rotor shaft and power shaft quill. An elongated slot is provided in the quill to permit axial reciprocation of the pin as the power shaft rotates. Helical slots are defined in each of the co-axial rotor shafts, one of the helical slots having a left-hand curve and the other having a right-hand curve. Cam rollers on extending ends of the drive pin ride in a cam track defined by cam surfaces on opposed annular cam sleeves secured within the cylinder. Relative rotation between the cylinder and rotor causes the pin to reciprocate axially and thereby effects rotary oscillation between the rotor vanes as the entire rotor rotates relative to the cylinder.

9 Claims, 44 Drawing Figures

OSCILLATING VANE ROTARY PUMP OR MOTOR

BACKGROUND OF THE INVENTION

1. Field of Invention

The present invention relates to oscillating vane type rotary pumps or motors and more particularly to a cam type actuating mechanism for oscillating rotor mounted vanes relative to each other in response to rotational movement of the rotor relative to a cylinder.

2. Brief Description of the Prior Art

Rotary pumps or motors including oscillating vanes on coaxial rotor elements are known in the art. See for example U.S. Pat. No. 4,153,396, issued May 8, 1979, to E. F. Landry, for "Rotary Engine or Pump"; and U.S. Pat. No. 3,183,898, issued May 18, 1965, to J. J. Sandone, for "Rotary Engine." While both of these references illustrate that oscillating vane rotary pumps or motors are known in the art, the mechanism for creating the relative oscillation between the vane rotors while the entire rotor assembly is rotating within a cylinder is complex and heretofore has required the machining of complex curved surfaces such as ellipses and various chanels and guideways, as shown by Landry, or internal tracks for receiving balls or keys as shown by Sandone.

OBJECTS AND SUMMARY OF THE INVENTION

The principal object of the present invention is to provide a high performance rotary pump or motor of the oscillating vane type having an improved drive and cam mechanism.

Another object of the present invention is to provide a pump or motor of the foregoing character which is compact, space efficient, capable of moving large volumes of liquids at high pressure, mechanically efficient, economical and reliable.

A further object of the present invention is to provide a pump or motor of the foregoing character which is adaptable for a wide variety of applications including industrial applications relating to oil, water and other chemicals.

Another and more specific object of the present invention is to provide an improved drive and cam system for driving the internal vanes of an oscillating vane type rotary pump or motor. More specifically, it is an object of this invention to provide a cam drive system which is simple, easily and economically constructed, contains a minimum of wearing parts, is rugged and reliable.

Other objects and advantages of the present invention will become apparent as the following description proceeds.

In accordance with the foregoing objects, an oscillating vane type rotary pump or motor includes a cylinder defining an inner cylindrical bore in which is rotatably mounted a primary and a secondary vaned rotor mechanism. The cylinder is closed at each end by circular endplates. The primary and secondary rotors each include a pair of sector shaped vanes, with the vanes on each rotor element spaced apart approximately 180°. The primary rotor is formed by an axially extending solid shaft supporting a pair of vanes. The secondary rotor is formed by a sleeve shaft and likewise supports a pair of vanes. When the primary shaft is inserted coaxially into the secondary sleeve shaft, the primary vanes are spaced intermediate the secondary vanes, all four being spaced apart at approximately 90° intervals around the circumference of the rotor. As the primary and secondary rotor shafts rotate or oscillate with respect to each other, the respective vanes define constantly expanding and contracting variable chambers. The co-axial rotor elements are driven by a power drive shaft, the sleeve shaft of the secondary rotor being inserted in a quill or barrel sleeve on the power shaft. The power shaft extends outwardly through one end plate of the cylinder.

For rotating the complete rotor assembly relative to the cylinder, the power shaft is pinned or coupled to the rotor shafts by a drive pin. In order to oscillate the vanes with respect to each other as the rotor and drive shaft rotate relative to the cylindrical housing, the power shaft quill includes a pair of diametrically opposed elongated slots for receiving the pin and allowing axial movement thereof. Each of the rotor shafts includes a helical slot, the slot on each shaft being of opposite hand with respect to the other. Thus, on the primary shaft the slot may be left-handed or right-handed, while on the secondary shaft the helical slot would be opposite, that is right-handed or left-handed. The pin extends through both the elongated drive quill slots and the helical slots, so that as the pin moves axially, the rotor assembly is rotated and simultaneously the primary and secondary rotors are oscillated with respect to each other as a result of the axial movement of the pin in the helical slots.

For reciprocating the pin axially, the ends of the pin extend outwardly from the power shaft quill and are provided with cam rollers. The rollers ride in a cam track defined within the cylinder. In one form, the cam track is defined by a pair of spaced cam sleeves secured within the cylinder and having opposed cam faces or surface defining the cam track. Depending on the configuration of the cam track, the pin moves axially a controlled distance back and forth and, in cooperation with the helical slots, oscillates the rotors and vanes with respect to each other.

By appropriate exhaust and intake ports, in conjunction with the variable chambers defined between the vanes, pumping effects can be achieved, or alternatively, a motor effect can be produced by supplying pressure fluid to the unit.

The rotary cams that drive the pin may be of any appropriate configuration, and together with the helical angle of the rotor slots determines the vane arc. The rate of acceleration of the rotors can be altered to suit the particular application. In a piston and crank design, the relative motion would be a sine wave in all cases. With this design, the relative motion can be controlled for different application and pressure conditions. Computer projections may by utilized to provide the desired efficiency.

The helical slots utilized in the rotor shafts are adaptable to a number of configurations. A single slot may be used on each shaft intersected by a single pin. Multiple slots and pins are both feasible and appear to have some advantages in load distribution. The slots can be of any desired angle, thereby providing for a great deal of flexibility in the design. The angle of the slots is determinative of design criteria. It effects the relationship with the other parts, particularly the cam track, and is the primary determinate of overall efficiency. The slots may be either of a normal taper or a compound taper in order to facilitate modifications of the cam profile. An "S" curve would be of some advantage in certain applications.

In their simplest form, the cam rollers are simply affixed on the protruding ends of the drive pin. This is useful for a low speed design, but modifications may be required for high speed or high load applications. As an alternative configuration, a pin and roller carrier that supports the pin and allows independant rollers to contact each cam face may be utilized. This configuration has advantages in that the rollers may operate in the same direction at all times. The principal feature of this invention is the combination of the pin, the rollers, the helical slots and the rotary cams.

The porting of the cylinder to provide for pump or motor operation is likewise variable. Changes in porting and manifolding can make a difference in how the device behaves under different conditions, and are readily determinable by one of ordinary skill in the art. The number of available combinations of port location are numerous. Porting of the inlet and outlet can be achieved by using ports on either end plate or around the periphery of the housing in any combination of locations. The ports may overlap in order to allow possitive bleed of pressure, or may be spaced apart. The design may be constructed to behave like a centrifugal pump without need for blow-off valves in a given system by appropriate port overlap. Port manifolding can be shaped to make the pump behave like a centrifugal pump even though it is a positive displacement type pump.

The rotors may be designed and shaped to produce different results within a desired case or cylinder size. Rotor length and vane size may be varied or altered; however, the most important dimension in determining the volume and the application of the design is the vane arc.

The design is suitable for configuration with a variety of options thereby making the pump suitable for most if not all desired applications. The pump is particularly adaptable to computer configuration for a particular task. Because of its small size, high efficiency and basic simplicity, the pump is uniquely suited to meet the foregoing objectives.

DESCRIPTION OF THE PREFERRED EMBODIMENT

Figures 1, 2, 3:
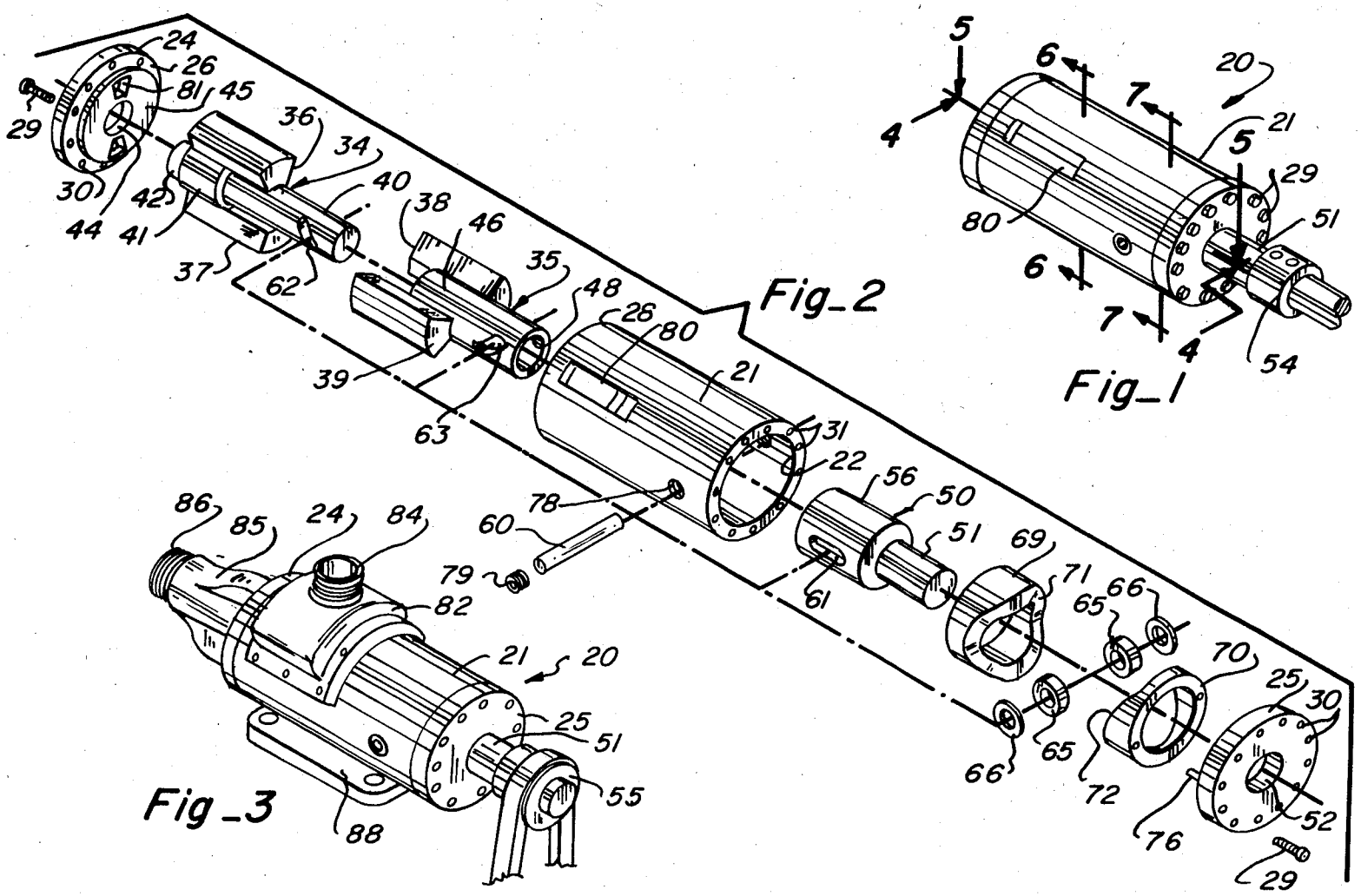
FIG. 1 is a perspective view of the principal cylinder and rotor mechanism of a pump and motor embodying the present invention.
FIG. 2 is an exploded view showing the external and internal working elements of the pump or motor shown in FIG. 1.
FIG. 3 is a perspective view similar to FIG. 1 showing the pump or motor with appropriate inlet and outlet manifolds and a power drive mechanism.

An oscillating vane type rotary pump or motor is shown in the drawings. Particularly with reference to FIGS. 1 through 7, there is shown a pump or motor 20 embodying the present invention. The mechanism includes an outer cylinder housing 21 defining an inner cylindrical bore 22 closed at each end by end plates 24, 25. The end plates 24, 25 are circular, flat, plates, each having an annular recess defining a sealing surface 26 adapted to seat against a corresponding end surface 28 of the cylinder 21. The sealing surfaces at each end of the cylinder and on each plate are machined to a finish sufficient to provide the desired seal. Appropriate sealing gaskets or O-rings may be used to provide the desired seal. The end plates 24, 25 are secured to the cylinder by cap screws 29 which extend through holes 30 in the end plates and are threadably engaged with corresponding tapped holes 31 in the cylinder wall.

Rotatably housed within the cylinder is an oscillating vane type rotor assembly, as shown in FIG. 2 and FIGS. 4–7. The rotor assembly is formed by a pair of co-axial rotor elements 34, 35 each having a pair of sector-shaped vanes 36, 37 and 38, 39 respectively. The vanes on each rotor element are spaced apart approximately 180°, and are of width sufficient to provide the desired configuration of the variable chambers formed between the co-acting vanes. The first or primary rotor element 34 is formed by an axially extending, solid, shaft 40 having a collar or enlarged cylindrical section 41 adjacent one end thereof and mounting the vanes 36, 37. One end 42 of the shaft 40 is journalled in a circular recess 44 on the face 45 of the adjacent end plate 24. The vanes 36, 37 extend or cantilever over but are spaced from the surface of the shaft 40.

Figure 4:
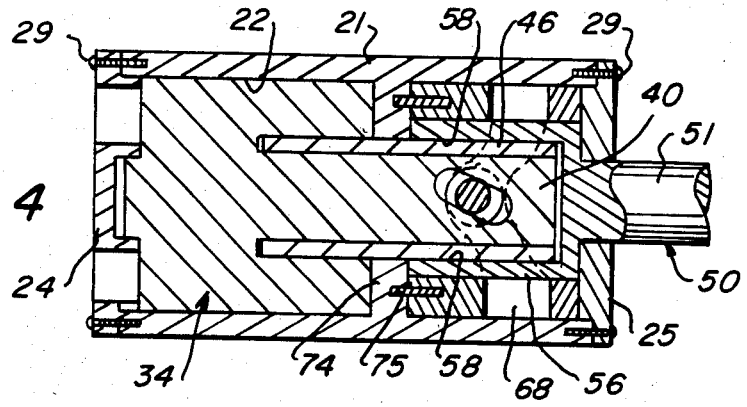
FIG. 4 is an enlarged section view taken substantially in the plane of line 4—4 on FIG. 1.
Figure 5:
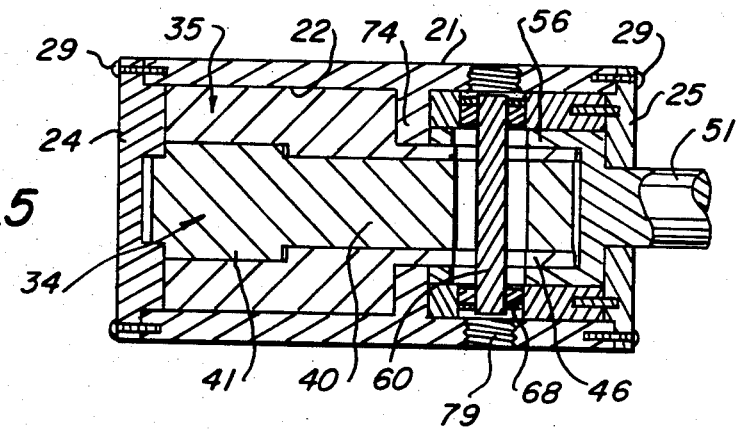
FIG. 5 is an enlarged section view taken substantially in the plane of line 5—5 on FIG. 1.
Figure 6:
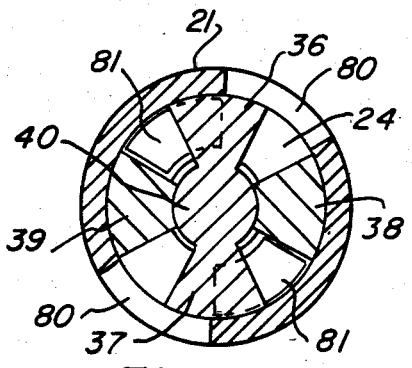
FIG. 6 is an enlarged section view taken substantially in the plane of line 6—6 on FIG. 1.
Figure 7:
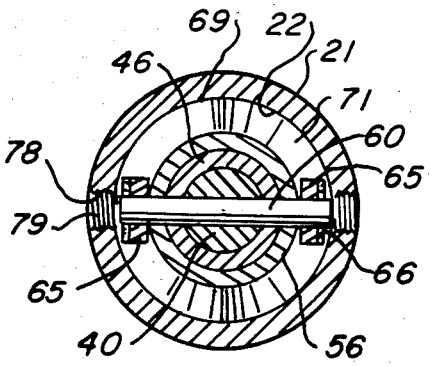
FIG. 7 is an enlarged section view taken substantially in the plane of line 7—7 on FIG. 1.

The second or secondary rotor element 35 is formed by a sleeve shaft 46 supporting the vanes 38, 39 at one end, and having a bore 48 of a size suitable for journalling an inserted end of the shaft 40 of the primary rotor 34. The secondary sleeve shaft 46 and primary shaft 40 are thus co-axial when the rotor elements are nested together. The sleeve shaft 46 is of a thickness sufficient to allow for the same to be inserted between the cantilevered vanes 36, 37 and the shaft 40 of the primary rotor 34. When so nested, the shaft 40 and sleeve shaft 46 of the respective primary and secondary rotor elements are co-extensive and co-axial, as shown in FIGS. 4 and 5.

For rotating the rotor assembly relative to the cylinder 21 when the primary rotor 34 and secondary rotor 35 are nested together, there is provided an input or output power drive shaft 50. The power drive shaft 50 includes a stub shaft or trunnion 51 at one end adapted to extend outwardly through and be journaled in a aperature 52 in the adjacent end plate 25 on the cylinder. At it outer end, the stub shaft 51 mounts an appropriate drive coupler, such as a flexible coupling 54 as shown in FIG. 1, or a pulley sheave 55, as shown in FIG. 3. For engagement with the rotor assembly, the power shaft 50 includes a sleeve or quill 56 having an internal bore sized to receive an inserted end of the sleeve shaft 46 of the secondary rotor, as shown in FIGS. 4 and 5.

For operatively coupling the power shaft 50 to the rotor assembly 34, 35 when the power shaft quill or barrel 56 is inserted over one end of the sleeve shaft 46 of the secondary rotary 35, with the primary rotor 34 and its shaft 40 inserted and journaled within the secondary rotor 35, there is provided a drive pin and cam mechanism embodying the present invention. To this end, a drive pin 60 is provided which extends through diametrically spaced, axially elongated slots 61 defined in the quill or sleeve 56 of the power shaft 50, and helical slots 62, 63 defined respectively in the shaft 40 of the primary rotor 34 and the sleeve shaft 46 of the secondary rotor 35. The elongated slots 61 in the power shaft barrel 56 allow the pin 60 to reciprocate axially with respect to the power shaft 50, while maintaining rotary driving engagement between the power shaft 50 and the rotor shafts 40, 46. The slots 62, 63 in the rotor shafts 40, 46 respectively are helically shaped, with the slots in the respective rotors being of opposite hand. That is, the helical slot 62 in the primary rotor shaft 40 is a right-hand or clockwise helix, while the slot 63 in the sleeve shaft 46 of the secondary rotor 35 is a left-hand or counterclockwise helix. With the pin 60 extending through the helical slots 62, 63, it can be readily seen that as the pin 60 moves axially, the primary and secondary rotors 34, 35 will be oscillated in opposite rotary directions with respect to each other. With this oscillatory movement, the vanes 36, 37 on the primary rotor move oppositely to the vanes 38, 39 on the secondary rotor, thereby alternately expanding and contracting the space or chambers defined between the respective vanes. It is this oscillating movement with the expansion and retraction of the adjoining spaces or chambers that provides the pump or motor action as the entire rotor assembly rotates within the cylinder. As the power shaft 50 rotates, the pin 60 likewise rotates and couples the power shaft 50 to the primary and secondary rotors 34, 35 to rotate the same within the cylinder 21.

In order to reciprocate the drive pin 60 axially longitudinally of the rotor axis as the rotor assembly and cylinder 21 rotate with respect to each other, there is provided a cam mechanism fixed within the cylinder 21 and drivingly engaging the drive pin 60. To this end, the pin 60 extends outwardly through the slots 61 in the power shaft quill 56, and is provided at each extending end with a cam roller 65. The cam rollers 65 are held on the outer ends of the drive pin 60 by appropriate clamp washers 66 or other suitable means. For reciprocating the cam rollers and thus the drive pin 60 axially with respect to the rotors, the cam rollers ride in a cam track 68 defined between opposed annular face cams 69, 70. The face cams 69, 70 each define a cam surface 71, 72 respectively, with corresponding peaks and valleys which cooperate to define a cam track 68 of the desired configuration. The annular face cams 69, 70, are secured within and fixed with respect to the cylinder 21. For this purpose, the cylinder 21 is provided with an internal annular wall or shoulder 74 against which an inserted cam sleeve 69 is adapted to seat, with appropriate pins 75, for securing the annular cam sleeve to the shoulder 74 to prevent rotation thereof. The outer cam sleeve 70 is likewise pinned against the face of the adjacent end cap 25, appropriate pins 76 being provided for this purpose engagable in corresponding apertures 77 in the cam ring 70.

With this configuration, as the power shaft 50 rotates, the drive pin 60 likewise rotates and the cam rollers 65 on the ends thereof follow the cam track 68 defined by the cam rings 69, 70. The drive pin 60 rotates the primary rotor 34 and secondary rotor 35 of the rotor assembly. Simultateously, the axial movement of the drive pin imparted by the roller cams riding in the cam track co-acts with the helical slots in the respective rotor shafts 40, 46 in the manner above described to oscillate the primary and secondary rotors 34, 35 and the vanes 36, 37 and 38, 39 carried thereby with respect to each other.

For assembling the rotors and power shaft with the drive pin and cams, an access port 78 is provided in the cylinder wall at a convenient location to allow for insertion of the pin through the respective drive slots 61, 62, and 63. A correspondingly threaded plug 79 closes the access port 78 when the assembly has been completed.

Referring to FIGS. 1 and 3, appropriate ports 80 are provided in the side wall of the cylinder 21 communicating with the variable chambers defined between the vanes 36, 37 of the primary rotor 34 and the adjacent vanes 38, 39 of the secondary rotor 35. Similarly, ports 81 are provided in the end plate 24 adjacent the rotor end of the cylinder. A manifold 82 encloses the lateral ports 80 and is provided with an intake or outlet port 84 for receiving or exhausting pressure fluid. A second manifold 85 is secured to the end plate 24 and encloses the end ports 81. An intake outlet port 86 is provided as a part of the end manifold 85.

Any appropriate drive coupling may be utilized to connect the power shaft 51 to an appropriate input or output mechanism. A support or base 88 may be secured or integrally formed as a part of the cylinder 21 depending upon the intended application for the pump or motor.

Referring to FIGS. 8*a*–8*g*, 9*a*–9*g*, 10*a*–10*g*, and 11*a*–11*g* various stages in the operation of the apparatus are illustrated showing the relationship between vane position, drive pin position, and cam position as determined by the position of the cam rollers in the cam track. FIGS. 8*a*–8*g* illustrate the position of the pin during a 180° rotation of the rotors. FIGS. 9*a*–9*g* illustrate the position of the cam rollers in the cam track during the same 180° of rotation. FIGS. 10*a*–10*g* illustrate the position of the pin and the relative helical slot position during the same 180° rotation. FIGS. 11*a*–11*g* illustrate the relative movement of the vanes of the primary and secondary rotors during the same 180° rotation of the rotors.

Figures 8A, 8B, 8C, 8D, 8E, 8F, 8G, 9A, 9B, 9C, 9D, 9E, 9F, 9G, 10A, 10B, 10C, 10D, 10E, 10F, 10G, 11A, 11B, 11C, 11D, 11E, 11F, 11G:
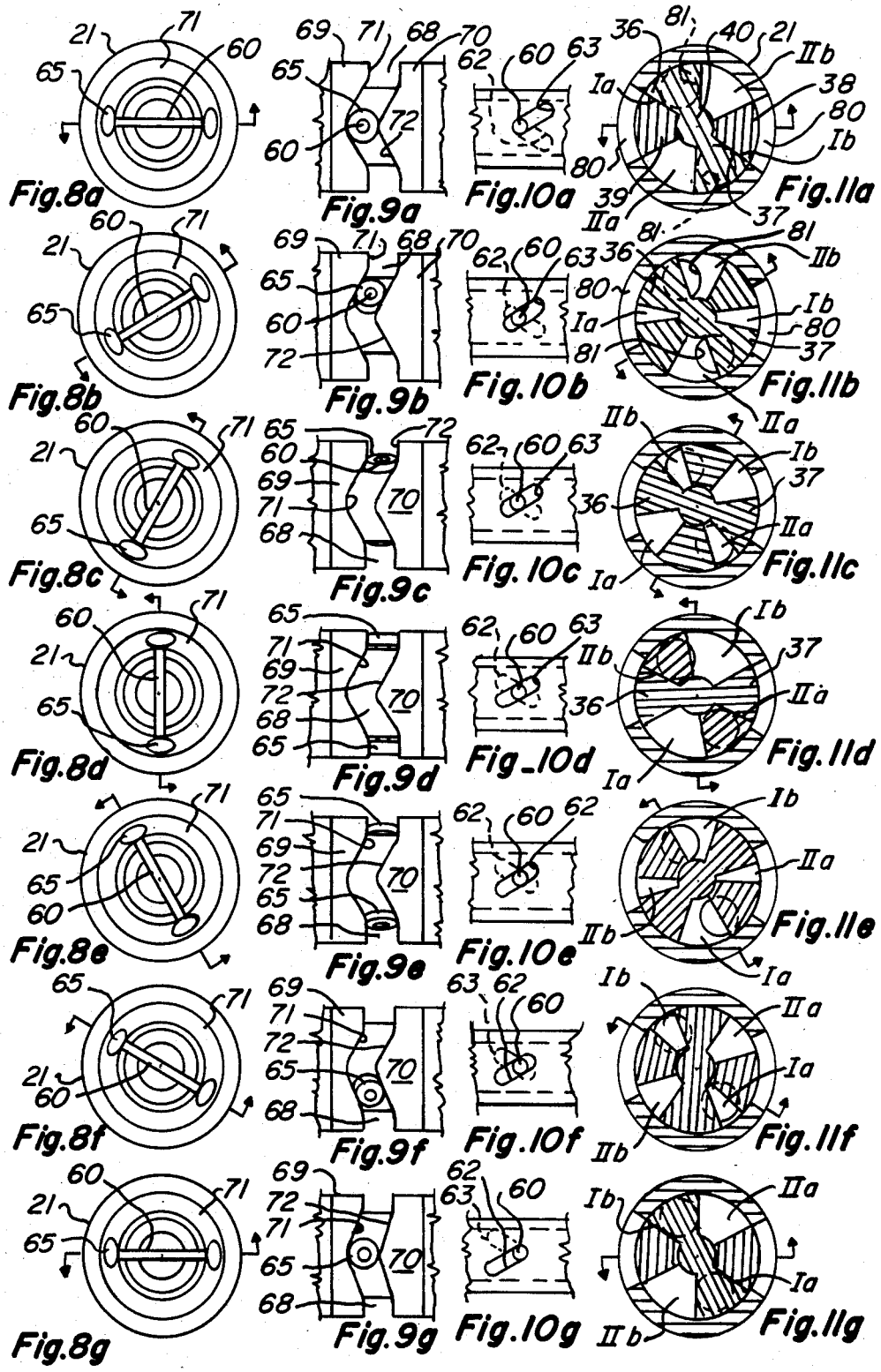
FIGS. 8*a*–8*g* are generally schematic views taken in vertical cross-section showing the drive pin and cam wheels in various positions during the operation of the cam drive mechanism as the pump or motor rotates.
FIGS. 9*a*–9*g* are views corresponding to FIGS. 8*a*–8*g* and showing the same relative position of the cam wheels and cam tracks.
FIGS. 10*a*–10*g* are views corresponding to FIGS. 8*a*–8*g* and 9*a*–9*g*, and showing the relative positions of the drive pin and helical slots in the respective co-axial rotor shafts.
FIGS. 11*a*–11*g* are views corresponding to FIGS. 8*a*–8*g*, 9*a*–9*g* and 10*a*–10*g*, and showing the relative positions of the rotor vanes corresponding to the drive pen on cam drive mechanism positions.

As shown in FIGS. 11*a*–11*g* the chambers defined between the rotor vanes vary from a minimum to a maximum volume depending upon the drive pin and cam locations. Referring to FIG. 11*a*, a first chamber Ia initially defined between one primary rotor vane 36 and the adjacent secondary rotor vane 39, and a diametrically opposed but identical chamber Ib is defined between the other primary rotor vane 37 and the other secondary rotor vane 38, both chambers Ia and Ib being initially at a minimum volume. Simultaneously, a second chamber IIa defined between a secondary rotor vane 39 and a primary rotor vane 37, and the diametrically opposed but identical chamber IIb defined between the other secondary rotor vane 38 and a primary rotor vane 36, are both at their maximum volume. At this point, the drive pin 60 is positioned as shown in FIG. 8, in a generally horizontal position and with the helical slots 62, 63 at their maximum extension. The lateral ports 80 in the cylindrical and the axial ports 81 in the cylinder cap are both closed by corresponding vanes.

As the drive pin 60 rotates, the cam wheels 65 ride in the cam track 68 to oscillate the vanes relative to each other. More specifically, as chamber Ia and Ib begin to expand, chambers IIa and IIb begin to contract, thereby partially exposing the respective cylinder and cap ports 80, 81. In the configuration shown, the secondary rotor vanes 38, 39 move counterclockwise, while the primary rotor vanes 36, 37 move clockwise relative to the secondary rotor vanes. During the entire oscillation, however, it must be kept in mind that the rotor as a whole moves counterclockwise. This movement continues until chambers IIa and IIb have reached their minimum volume as shown in FIG. 11*d*, while chambers Ia and Ib have reached their maximum volume. The cycle continues with chambers IIa and IIb beginning to expand, and chambers Ia and Ib beginning to contract, as shown in FIG. 11*e*, with the chambers gradually enlarging and contracting respectively until chambers Ia and Ib are once again at their minimum volume and chambers IIa and IIb are at their maximum volume, as shown in FIG. 11*g*, but with the rotation having progressed 180°. This 180° rotation may be observed by noting that chambers Ia and Ib have reversed position, as shown by comparing FIGS. 11*a* and 11*b*. The cycle continuously produces a chamber expansion followed by a chamber compression or contraction.

As the cycling continues, ports 80 and 81 are continuously opened and closed. If power is being applied to the unit, it acts as a pump, with the lateral ports 80 being suction or intake ports, and the end ports 81 serving as exhaust or outlet ports. If the unit is serving as motor, the lateral ports 80 on the cylinder sides would serve as the high pressure or pressure fluid input ports, while the ports on the end of the cylinder would serve as the low pressure or exhaust ports. In the motor configuration, a fly wheel or inertia wheel would desirably be utilized in order to prevent the motor from stabilizing itself in a position in which all ports are closed.

Figure 12A:
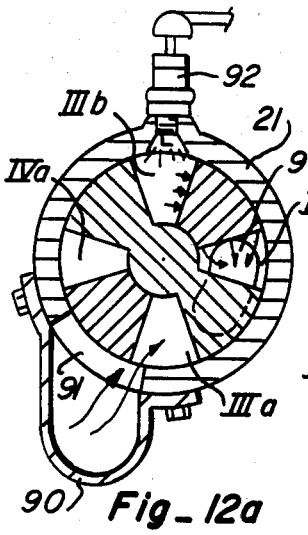
FIGS. 12*a*–12*c* are a generally schematic cross-sectional representation of the vane positions when the device is used as an internal combustion motor.
Figure 12B:
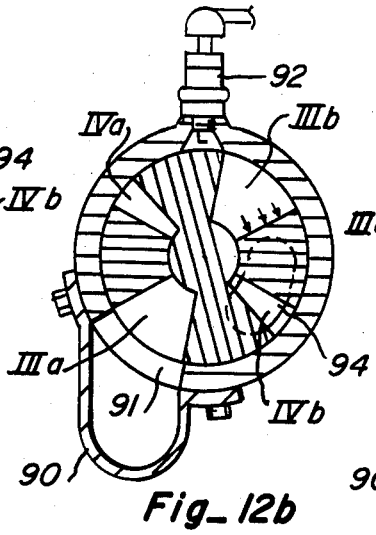
Figure 12C:
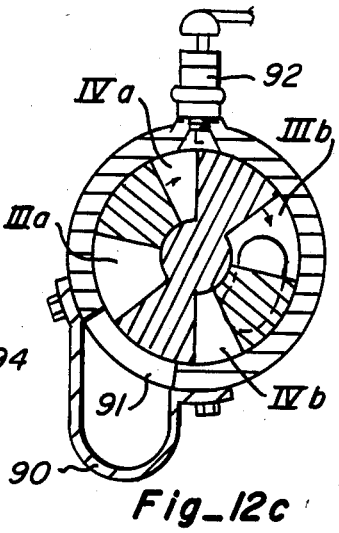

The use of the motor as an internal combustion engine is shown in FIGS. 12*a*, 12*b*, and 12*c*. In this configuration, an intake manifold 90 is provided on the cylinder 21 in communication with an intake port 91 in the cylinder wall. The intake port 91 communicates with a vane chamber IIIa at its maximum expansion volume. Simultaneously, the adjacent leading chamber IVa is at its maximum compression, as shown in FIG. 12*b*. Assuming that the gas in the chambers is combustible, a spark plug 92 or like ignition device ignites the compressed gas in chamber IIIb, while burned gas in chamber IVb is exhausted through an exhaust port 94. As the rotation continues the cycle repeats and the motor runs continuously so long as fuel is supplied through the intake manifold 90 and energy is applied to the spark or igniter 92.

Figure 13A:
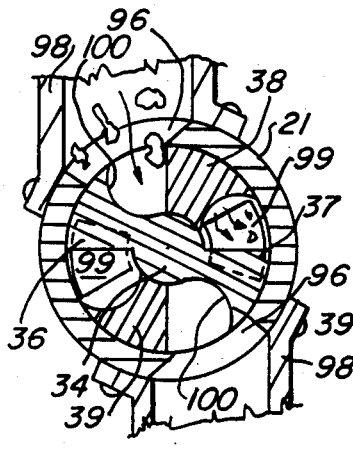
FIGS. 13*a*–13*c* are a generally schematic representation, in transverse cross-section showing the vane positions when the device is used as a pump.
Figure 13B:
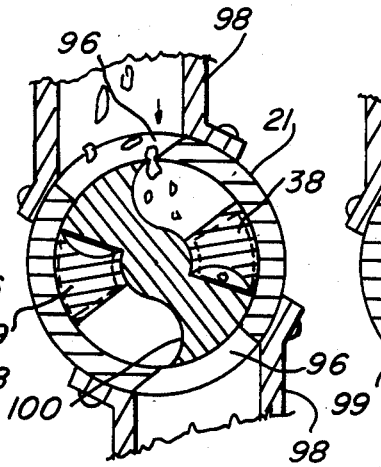
Figure 13C:
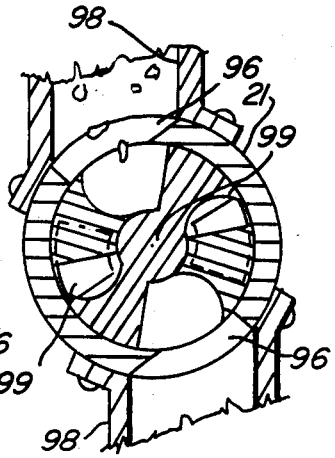

FIGS. 13*a*, 13*b*, and 13*c* illustrates the operation of the device as a pump for a liquid containing particulate matter or viscous liquids. A relatively large intake port 96 is provided on diametrically opposite sides of the cylinder 21, and the liquid being pumped is supplied to each port 96 by a conduit or manifold 98. Outlet or exhaust ports 99 are provided on the adjacent cylinder end cap. In this configuration, the leading face 100 of each vane is desirably recessed in order to enlarge capacity of the suction chamber. This configuration is suitable for noncompressible fluids such as crude oil.

Figure 14:
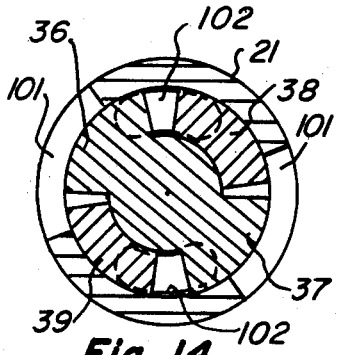
FIG. 14 is a schematic cross-section view showing one configuration of intake and exhaust ports, with relatively wide but not overlapping ports.
Figure 15:
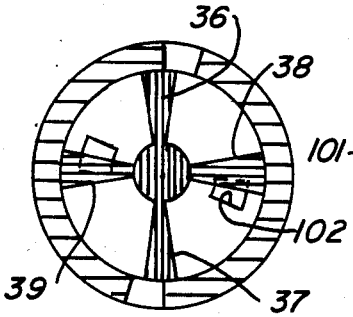
FIG. 15 is a schematic transverse cross-section showing another exhaust and intake port arrangement, with relatively narrow ports and vanes.
Figure 16:
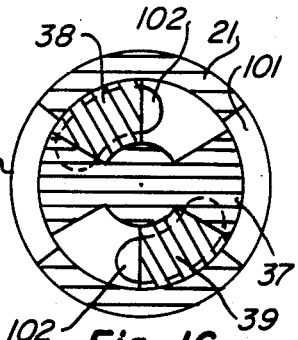
FIG. 16 is a schematic transverse cross-section showing still another port arrangement, with the intake and exhaust ports overlapping to provide a system similar in operation to a centrifugal pump.

FIGS. 14, 15, and 16 illustrate various port and vane configurations which may be utilized. In FIG. 14, the vanes 36, 37, 38, 39 are relatively wide, that is the vanes occupy a substantial arc, and the corresponding cylinder wall ports 101 and end plate ports 102 are large. For less viscous liquids, or even gases, narrower vanes 36, 37, 38, 39 may be utilized with smaller cylinder wall ports 104 and end plate ports 105 as shown in FIG. 15. FIG. 16 illustrates a vane and port configuration similar to FIG. 14, but in which the pump is comparable in action to a centrifugal pump. In this configuration, the cylinder wall ports 101 overlap the end plate ports 102 to provide a continuous suction and exhaust flow path.

While a certain illustrative embodiment of the present invention has been shown in the drawings and described in considerable detail, together with modifications of the vane and port configurations, it should be understood that there is no intention to limit the invention to the specific forms disclosed. On the contrary, the intention is to cover all modifications, alternative constructions, equivalents and uses falling within the spirit and scope of the invention as expressed in the appended claims.

What is claimed is:

1. In an oscillating vane rotary pump or motor including a cylinder housing a pair of co-axial rotors each having a plurality of vanes theron, each of said rotors having an axially extending shaft, a power shaft journaled in said cylinder and having a portion extending outwardly of said cylinder and an internal quill portion housed within said cylinder, said rotor shafts and said quill being co-axially telescoped together, and a cam mechanism operatively coupling said power shaft quill and said rotor shafts for rotation with respect to said cylinder and for oscillating said rotor shafts relative to each other in response to relative rotation between said cylinder and said rotors, said cam mechanism comprising means defining an axially elongated slot in said quill, means defining a helical slot in each of said rotor shafts, said helical slots in said rotor shafts each being of opposite hand with respect to the other, a drive pin extending through said quill and helical slots, and a cam including a cam roller on said pin and a cam track on said cylinder for reciprocating said pin axially in said slots in response to rotation of said rotors in said cylinder, thereby effecting relative rotational oscillational movement between said rotors and thereby the vanes supported thereon for providing alternating expanding and contracting chambers between said vanes.

2. In an oscillating vane rotary pump or motor including a cylinder housing a pair of co-axial rotors each having a plurality of vanes theron, each of said rotors having an axially extending shaft, a power shaft journaled in said cylinder and having a portion extending outwardly of said cylinder and an internal quill portion housed within said cylinder, said rotor shafts and said quill being co-axially telescoped together, and means operatively coupling said power shaft quill and said rotor shafts for rotation with respect to said cylinder and for oscillating said rotor shafts relative to each other in response to relative rotation between said cylinder and said rotors, said coupling means comprising means defining an axially elongated slot in said quill, means defining a helical slot in each of said rotor shafts, said helical slots in said rotor shafts each being of opposite hand with respect to the other, a drive pin extending through said quill and helical slots, and means for reciprocating said pin axially in said slots in response to rotation of said rotors in said cylinder, thereby effecting relative rotational oscillational movement between said rotors and thereby the vanes supported thereon for providing alternating expanding and contracting chambers between said vanes.

3. In an oscillating vane rotary pump or motor, comprising a cylinder, a pair of co-axial rotors journaled in said cylinder for relative rotation with respect thereto, each of said rotors defining a pair of spaced apart sector shaped vanes with the vanes of one rotor intermediately juxtaposed with the vanes of the other, a power shaft journaled in said cylinder and extending outwardly from one end thereof, said rotors each having a shaft extending axially therefrom, said shafts extending co-axially within said cylinder, a quill on said power shaft internal of said cylinder and co-axially journaling said rotor shafts, means operatively coupling said power shaft to said rotor shafts for rotation therewith, and means in said cylinder defining inlet ports for receiving a fluid and exhaust ports for exhausting fluid from said cylinder, said operative coupling means including means for oscillating said vaned rotors with respect to each other as said rotors rotate with respect to said cylinder, said oscillating means comprising a pair of opposed axially elongated slots defined in said quill, a helical slot defined in each of said co-axial rotor shafts, one of said helical slots having a left-hand curvature and the other having a right-hand curvature, a drive pin extending through said axial quill slots and said helical rotor slots and extending outwardly of said quill on diametrically opposite sides thereof, cam rollers on the extending ends of said drive pin, a pair of opposed annular face cam rings fixed in said cylinder adjacent said rotor and quill slots, said cam rings having opposed cam surfaces defining a cam tract for receiving and guiding said cam rollers, whereby relative rotation of said cylinder and said power shaft causes said cam rollers to follow said cam track and thereby reciprocate said drive pin axially in said quill slots as said pin rotationally couples said power shaft to said rotor shafts, said axial reciprocation of said pin effecting rotary oscillation of said rotors opposite to one another with said juxtaposed vanes defining alternating expanding and contracting chambers in fluid pressure relationship with said inlet and exhaust ports.

4. An oscillating vane rotary pump or motor comprising a cylinder, a pair of co-axial vaned rotors journaled in said cylinder for relative rotation with respect thereto, each of said rotors defining a pair of spaced apart sector shaped vanes with the vanes of one rotor intermediately juxtaposed with the vanes of the other, a power shaft journaled in said cylinder and extending outwardly from one end thereof, said rotors each having a shaft, said rotor shafts extending co-axially within said cylinder, a quill on said power shaft co-axially engaging said rotor shafts, and mean operatively coupling said power shaft to said rotor shafts for rotation therewith and for simultaneously oscillating said rotor shafts relative to each other, and means in said cylinder defining inlet ports for receiving a fluid and exhaust ports for exhausting a fluid from said cylinder in response to the relative rotational oscillation of said rotors, the improvement comprising diametrically opposed axially extending slots in said quill, a helical slot in each of said rotor shafts, said helical slots being of opposite hand, a drive pin extending through said slots in said quill and said rotor shafts and operatively coupling said quill and rotor shafts, and a cam operatively engaging said drive pin and said cylinder for axially reciprocating said drive pin in response to rotational movement of said power shaft relative to said cylinder thereby rotationally driving said vaned rotors relative to said cylinder and simultaneously rotationaly oscillating said vaned rotors relative to each other to define alternating expanding and contracting chambers for receiving and exhausting fluid in response to said relative rotation between said rotors and said cylinder.

5. An oscillating vane rotary pump or motor comprising a cylinder, a pair of co-axial vaned rotors journaled in said cylinder for relative rotation with respect thereto, each of said rotors having a plurality of spaced apart sector shaped vanes with the vanes of one rotor intermediately juxtaposed with the vanes of the other, a power shaft journaled in said cylinder and extending outwardly from one end thereof, said rotors each having a shaft, said rotor shafts extending coaxially within said cylinder, a quill on said power shaft coaxially engaging said rotor shafts, and mean operatively coupling said power shaft to said rotor shafts for rotation therewith and for simultaneously oscillating said rotor shafts relative to each other, and means in said cylinder defining inlet ports for receiving a fluid and exhaust ports for exhausting a fluid from said cylinder in response to the relative rotational oscillation of said rotors, the improvement comprising diametrically opposed axially extending slots in said quill, a curved slot in each of said rotor shafts, each of said curved slots being curved in an opposite direction with respect to the other, a drive pin extending through said slots in said quill and said rotor shafts and operatively coupling said quill and rotor shafts, and means operatively engaging said drive pin and said cylinder for axially reciprocating said drive pin in response to rotational movement of said power shaft relative to said cylinder thereby rotationally driving said vaned rotors relative to said cylinder and simultaneously rotationaly oscillating said vaned rotors relative to each other to define alternating expanding and contracting chambers for receiving and exhausting fluid in response to said relative rotation between said rotors and said cylinder.

6. An oscillating vane rotary internal combustion engine comprising a cylinder housing a pair of co-axial rotors each having a pair of vanes thereon, each of said rotors having an axially extending shaft, a power output shaft journaled in said cylinder and having a portion extending outwardly of said cylinder and an internal quill portion housed within said cylinder, said rotor shafts and said quill being co-axially telescoped together, and a means operatively coupling said power shaft quill and said rotor shafts for rotation with respect to said cylinder and for oscillating said rotor shafts relative to each other in response to relative rotation between said cylinder and said rotors, said coupling means comprising means defining an axially elongated slot in said quill, means defining a helical slot in each of said rotor shafts, said helical slots in said rotor shafts being of opposite hand with respect to each other, a drive pin extending through said quill and helical slots, means for reciprocating said pin axially in said slots in response to rotation of said rotors in said cylinder, thereby effecting relative rotational oscillational movement between said rotors and thereby the vanes supported thereon for providing compression and expansion chambers between said vanes, an intake port in said cylinder, a fuel manifold communicating with said intake port, an exhaust port in said cylinder an exhaust manifold communicating with said exhaust port, and means in said cylinder for igniting compressed fuel in a compressed ignition chamber, said ignited fuel expanding to drive said rotors by expanding the ignition chamber between said vanes, the burned fuel gas from said expanded ignition chamber being exhausted through said exhaust port and manifold as said chamber subsequently contracts, said chamber again expanding to receive fuel from said inlet port and manifold.

7. An oscillating vane engine as defined in claim 6 wherein said oscillating means comprises a cam including cam rollers on said pin and a cam track in said cylinder for receiving and guiding said cam rollers to reciprocate said drive pin axially in said slots.

8. An oscillating vane rotary pump comprising a cylinder housing a pair of co-axial rotors each having a pair of vanes thereon, each of said rotors having an axially extending shaft, a power input shaft journaled in said cylinder and having a portion extending outwardly of said cylinder and an internal quill portion housed within said cylinder, said rotor shafts and said quill being co-axially telescoped together, and means operatively coupling said power shaft quill and said rotor shafts for rotation with respect to said cylinder and for oscillating said rotor shafts relative to each other in response to relative rotation between said cylinder and said rotors, said coupling means comprising means defining an axially elongated slot in said quill, means defining a helical slot in each of said rotor shafts, said helical slots in said rotor shafts each being of opposite hand with respect to the other, a drive pin extending through said quill and helical slots, means for reciprocating said pin axially in said slots in response to rotation of said rotors in said cylinder, thereby effecting relative rotational oscillational movement between said rotors and thereby the vanes supported thereon for providing alternating expanding and contracting chambers between said vanes, a pair of diametrically spaced intake ports in said cylinder, a pair of output ports in said cylinder, an intake manifold communicating with said intake ports, an output manifold communicating with said output ports, and means for applying a motive force to said power input shaft, said intake ports communicating with said vane defined chambers when said chambers are at their maximum volume, and said output ports communicating with said vane defined chambers when said chambers are at their minimum volume.

9. An oscillating vane engine as defined in claim 8 wherein said oscillating means compressed a cam including cam rollers on said pin and a cam track in said cylinder for receiving and guiding said cam rollers to reciprocate said drive pin axially in said slots.

* * * * *